United States Patent [19]

Ziolo

[11] 4,150,173

[45] Apr. 17, 1979

[54] PROCESS OF PREPARING TRANSPARENT COLORED MAGNETIC MATERIALS

[75] Inventor: Ronald F. Ziolo, Webster, N.Y.

[73] Assignee: Xerox Corporation, Stamford, Conn.

[21] Appl. No.: 710,537

[22] Filed: Aug. 2, 1976

[51] Int. Cl.[2] ..... H01F 10/04

[52] U.S. Cl. ..... 427/130; 427/127; 427/128; 427/132; 427/217; 427/230

[58] Field of Search ..... 427/47, 217, 127–132, 427/230; 252/62.54; 428/400

[56] References Cited

U.S. PATENT DOCUMENTS

| | | | |
|---|---|---|---|
| 3,549,412 | 12/1970 | Frey et al. | 427/217 |
| 3,770,500 | 11/1973 | Imaoka et al. | 427/130 |
| 4,020,236 | 4/1977 | Aonuma et al. | 427/127 X |

*Primary Examiner*—Bernard D. Pianalto

[57] ABSTRACT

Transparent colored materials having low bulk densities and high magnetic permeabilities are obtained by encasing silicaceous particles in a sheath of magnetic or magnetically-attractable metal, which are then heat-treated. The magnetic composite particles are prepared by the solution phase thermal decomposition of transition metal carbonyls in the presence of the silicaceous particles with a suitable suspending medium. Air and moisture are excluded from the reaction vessel and the contents are heated with agitation so that the carbonyl boils and the mixture is refluxed until the temperature rises to that of the suspending medium whereupon coating of the silicaceous particles with elemental metal is complete. The mixture is cooled, the beads washed, air-dried, and recovered. The metal coated particles are then heated in an ambient atmosphere for between about 2 to about 120 minutes at a temperature of from between about 50° C. and 700° C. Particles having transparency, color, and magnetism in the same body are obtained.

11 Claims, 2 Drawing Figures

PROCESS OF PREPARING TRANSPARENT COLORED MAGNETIC MATERIALS

BACKGROUND OF THE INVENTION

Figure 1:
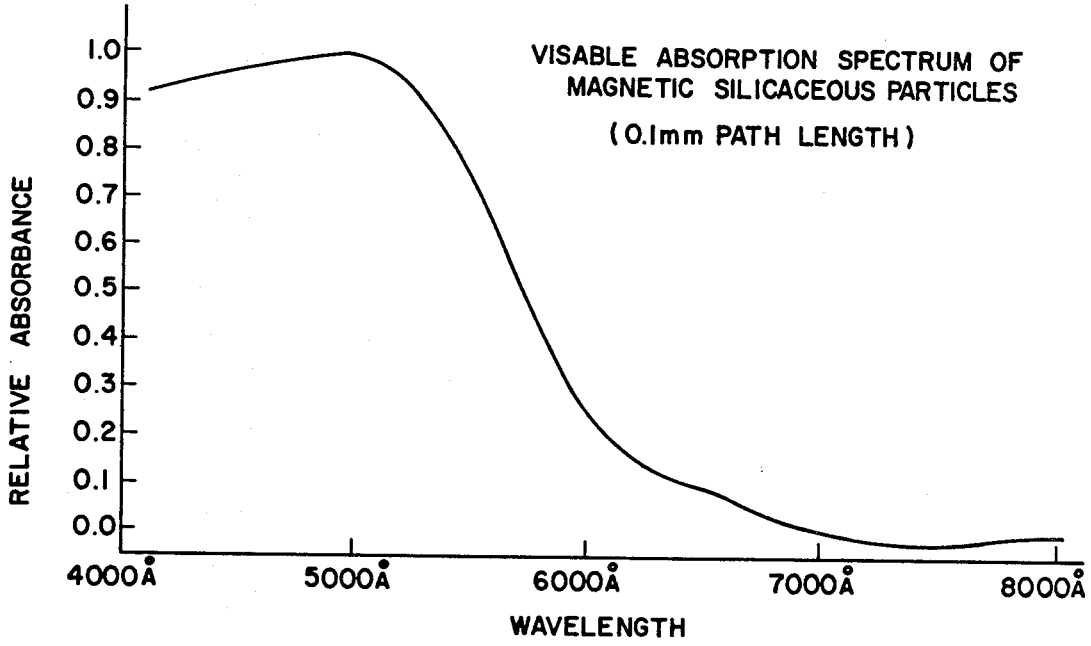

This invention relates to materials and process for recording information onto a copy sheet. More specifically, the invention relates to transparent colored ferromagnetic materials for use in magnetic imaging systems.

Various systems are well known for high volume duplicating of copies including mimeograph, spirit duplicating, lithography, and the like. At the same time, there are known reproduction systems generally regarded as more suitable for lower volume rates such as xerography and photography which offer the distinct advantage of an optical input in reproducing a copy of an original.

In accordance with this invention, there is at least partially employed the process of xerography as, for example, disclosed in Carlson, U.S. Pat. No. 2,297,691, issued Oct. 6, 1942, or may include variations thereof for placing a developable image charge pattern on a support as disclosed, for example, in U.S. Pat. Nos. 2,825,814; 2,919,967; and 3,015,304. Likewise a latent magnetic image could be formed and utilized as disclosed in U.S. Pat. No. 2,857,290. As first taught by Carlson, a xerographic plate comprising a layer of photoconductive insulating material on a conductive backing is given a uniform electric charge over its surface and is then exposed to the subject matter to be reproduced, usually by conventional projection techniques. This exposure discharges the plate area in accordance with the radiation intensity that reaches them, and thereby creates an electrostatic latent image on or in the photoconductive layer. Development of the latent image is effected with an electrostatically charged, finely-divided material such as an electroscopic powder that is brought into surface contact with the photoconductive layer and is held thereon electrostatically in a pattern corresponding to the electrostatic latent image. Hereafter, the developed xerographic image may be affixed directly to the surface on which it is developed, or as usually performed, is transferred to a secondary support on which it is affixed by any suitable means.

Now in accordance with the instant invention, there is provided selectively colored magnetic materials for use in color magnetic imaging systems.

It is, therefore, an object of this invention to provide novel materials for copy duplicating.

It is a further object of this invention to provide novel transparent ferromagnetic materials.

It is a further object of this invention to provide the formation of transparent amber to red colored materials which are magnetic.

It is a further object of this invention to provide a fine dispersion of ferrimagnetic material throughout a highly porous silicaceous material.

It is still a further object of this invention to provide a process of producing transparent magnetic particles.

It is still another object of this invention to provide transparent magnetic particles of a desired color.

The above objects and others are accmplished in accordance with this invention, generally speaking, by encasing particles of a silicaceous material in a sheath of a magnetic or magnetically-attractable material, and then heating the coated material in air to a temperature of from between about 50° C. and 700° C. for between about 2 minutes and about 120 minutes. The particles thus obtained are colored and are translucent to transparent which when placed near a bar magnet are attracted to the bar magnet. It is generally accepted that bodies exhibiting gross magnetic behavior must be nontransparent or opaque and are usually very drak in color. Thus, it is unusual and unexpected to discover that transparency, color, and magnetism can reside in the same body. In accordance with this invention, it has been found that after heating in the foregoing manner, the particles remain spherical and singular, but become translucent to clear in appearance and colored amber to orange to red by transmitted light, having a slight metallic luster by reflected light, and have magnetic properties. Moreover, the magnetic property is continuous in that fragments from crushed or broken bodies retain the properties of the parent body. Further, where additional color variation is desired, metal oxides and other conventional glass coloring additives may be employed to color the magnetic silicaceous bodies to any desired color to provide transparent, selectively-colored magnetic materials for use such as in magnetic color imaging systems. Obviously, other methods of modifying the color of the magnetic silicaceous materials of this invention are available such as by atmosphere control and chemically pre-treating the silicaceous particles. Such modifications are considered to be within the scope of this invention.

Generally speaking, the transparent colored magnetic materials of this invention are prepared by the solution phase thermal decomposition of transition metal carbonyls and deposition thereof onto particles of a silicaceous material followed by heating at elevated temperature in the ambient atmosphere. More particularly, the transparent colored magnetic materials of this invention are prepared by placing particles of a silicaceous material in a suitable container along with a transition metal carbonyl and a suspending medium, displacing air and moisture from the container with a dry inert gas, heating the mixture with agitation to thermally decompose the transition metal carbonyl, refluxing the mixture for up to about 24 hours at the temperature of the suspending medium whereupon the silicaceous material is coated with the elemental metal of the transition metal carbonyl, cooling the mixture, washing the metal coated silicaceous particles with fresh suspending medium, air drying the metal coated silicaceous particles, heating the metal coated silicaceous particles in a suitable container, e.g. ceramic, in air to a temperature of from between about 50° C. and about 700° C. for between about 2 and about 120 minutes, and cooling the metal coated silicaceous particles to room temperature in an ambient atmosphere.

Magnetically, these composite structures respond like a collection of solid, fine iron particles, but surprisingly they are translucent to transparent in the wavelength region of from about 5,000 Å and above as depicted in FIG. 1. In FIG. 1, the visible absorption spectrum of the composite structures is illustrated. The spectrum was obtained on a Cary 118 spectrophotometer using a tungsten lamp source in the wavelength region of 4,000 to 8,000 Angstroms. A 0.1 mm path length quartz cell was used with the material suspended in water. The spectrum clearly indicates the transparency of the material in the region from about 5,000 to 8,000 Angstroms where absorption is at a minimum. The spectrum is that of the dispersion of $\gamma$-$Fe_2O_3$. Magnetic measurements have indicated that the composites are magnetic equivalents to their magnetic constituent, taking into account the difference in density between the composite and that of its constituent. When employing iron pentacarbonyl as the transition metal carbonyl, characterization of the magnetic silicaceous composites reveals a fine dispersion of ferrimagnetic $\gamma$-$Fe_2O_3$ (maghemite) throughout a highly porous glass matrix.

Generally, the thermal decomposition of typical transition metal carbonyls may be exemplified by the following equations for (1) iron pentacarbonyl, and (2) dicobalt octacarbonyl;

$$Fe(CO_5) \xrightarrow{\Delta} FE + 5CO \quad (1)$$

$$Co_2(CO)_8 \xrightarrow{\Delta} 2Co + 8CO \quad (2).$$

The decomposition of the transition metals is performed in the presence of silicaceous substrates and utilized to prepare composite materials having both chemical and mechanical stability and which display gross magnetic behavior. Substrate configuration is retained throughout the coating process. The bulk magnetic response of the composite materials may be controlled by varying the mass of the magnetic metal in proportion to the coated particle mass.

Any suitable magnetic or magnetically-attractable transition metal may be employed to coat or impregnate the substrates of the transparent colored magnetic materials of this invention. Typical such transition metals may be provided from iron pentacarbonyl, di-iron nonacarbonyl, tri-iron dodecacarbonyl, iron carbonyl cluster compounds, dicobalt octacarbonyl, nickel tetracarbonyl, other thermally extrudable compounds of such transition metals, and mixtures thereof that will not substantially hinder the optical transmission properties of the composite.

The temperature employed to produce the transparent magnetic materials of this invention depends upon the thermal properties of the composite being treated. In general, if a higher temperature is used the duration of the heat-treatment of a given composite would be shortened and vice versa. In any event, the composite exposed to the heat-treatment must be raised and maintained at a temperature sufficient to produce the desired optical and magnetic properties.

Any suitable silicaceous material may be employed as the substrate for the transparent colored magnetic material of this invention. Typical silicaceous materials include glass particles in various forms such as hollow glass beads, foam glass nodules, solid glass beads, microporous glass beads, glass chips, and fumed silica particles. In addition, vitreous materials may also be used. Thus, a wide variety of particulate materials the surface and pores of which can be coated or impregnated with a magnetic or magnetically-attractable transition metal may be employed in accordance with this invention. As indicated, the transparent colored magnetic composition of this invention may vary in size and shape. However, it is preferred that the composite material have a spherical shape as to avoid rough edges or protrusions which have a tendency to abrade more easily. Particularly useful results are obtained when the composite material has an average particle size from about 10 microns to about 300 microns, although satisfactory results may be obtained when the composite material has an average particle size of from between about 10 microns and about 850 microns. The size of the particles employed will, of course, depend upon several factors, such as the type of images ultimately developed, the machine configuration, and so forth.

The silicaceous material employed as the substrate for the composite magnetic transparent particles of this invention may have any suitable bulk density. Typically, the silicaceous material has an average bulk density of between about 0.2 and about 3.0 g/cm$^3$. The silicaceous material employed as the substrate for the transparent magnetic composite particles of this invention may have a smooth surface, it may have cracks or fissures in the surface, and it may be porous. For example, the silicaceous material may be microporous, microreticulated silicaceous beads having an average pore size of from between about 10 Å and about 500 Å. The silicaceous material may have a surface area of up to about 400 m$^2$/gram. When the silicaceous substrate is microporous with open pores, the magnetic metal may be deposited within the carrier beads in the form of continuous threads or films which provides a practical advantage in that the magnetic metal is well protected against abrasion. It does not matter for magnetic purposes whether the magnetic material resides on the surface or is impregnated in the interior of the beads as to their performance as magnetic particles. A range of volume ratios of silicaceous material to magnetic elemental metal that will provide satisfactory magnetically responsive composite particles is from between about 5:1 to 20:1.

Any suitable solvent or suspending medium may be employed in the thermal decomposition process of preparing the low density magnetic transparent composite particles of this invention. Typical solvents and suspending mediums may be hydrocarbon solvents with boiling points preferably above that of the transition metal compound employed. Satisfactory results have been obtained with n-octane.

The transparent colored magnetic materials of the instant invention may be employed to form magnetic images on any suitable image-bearing surface including conventional photoconductive surfaces. Typical inorganic photoconductor materials include: sulfur, selenium, zinc sulfide, zinc oxide, zinc cadmium sulfide, zinc magnesium oxide, cadmium selenide, zinc silicate, calcium strontium sulfide, cadmium sulfide, mercuric iodide, mercuric oxide, mercuric sulfide, indium tri-sulfide, gallium selenide arsenic disulfide, arsenic trisulfide, arsenic triselenide, antimony trisulfide, cadmium sulfoselenide, and mixtures thereof. Typical organic photoconductors include: quinacridone pigments, phthalocyanine pigments, triphenylamine, 2,4-bis(4,4'-diethylaminophenol)-1,3,4-oxadiazol, N-isopropylcarbazole, triphenylpyrrole, 4,5-diphenylimidazolidinone, 4,5-diphenylimidazolidinethione, 4,5-bis-(4'aminophenyl)-imidazolidinone, 1,4-dicyanonaphthalene, 1,4-dicyanonaphthalene, aminophthalocinitrile, nitrophthalodinitrile, 12,3,5,6-tetra-azacyclooctatetraene-(2,4,6,8), 2-mercaptobenzothiazole-2-phenyl-4-diphenylidene-oxazolone, 6-hydroxy-2,3-di(p-methoxyphenyl)-benzofurane, 4-dimethylaminobenzylidene-benzhydrazide, 3-benzylidene-aminocarbazole, polyvinyl carbazole, (2-nitrobenzylidene)-p-bromoaniline, 2,4-diphenyl-quinazoline, 1,2,4-triazine, 1,3-diphenyl-3-methyl-pyrazoline, 2-(4'-dimethylamino phenyl)-benzoxazole, 3-amine-carbazole, and mixtures thereof. Representative patents in which photoconductive materials are disclosed include U.S. Pat. Nos. 2,803,542 to Ullrich, 3,121,007 to Middleton, and 3,151,982 to Corrsin.

The magnetic transparent materials produced by the process of this invention provide numerous advantages. For example, they may be employed as pigments in such applications as in magnetic color imaging systems. Further, specifically colored low density magnetic bodies may be obtained in accordance with this invention for numerous particular applications where transparency, color, and magnetism are desired in the same body.

The following examples further define, describe, and compare preferred methods of preparing and utilizing the magnetic particles of the present invention. Parts and percentages are by weight unless otherwise indicated.

In the following examples, iron pentacarbonyl (99.5 percent purity) was obtained from Ventron Corporation, Danvers, Mass. and filtered before use to remove iron oxides. N-octane (practical) was obtained from Eastman-Kodak Company, Rochester, New York and refluxed over sodium for at least 24 hours and distilled before use. Hollow glass spheres were obtained from Emerson and Cuming, Inc., Canton, Mass. under the tradename of "Eccospheres" and were used as received. Porous glass beads were obtained from PPG Industries, Pittsburg, Pa. and were used as received. Similar porous glass particles were obtained from Corning Glass Works, Corning, N.Y. as 7930 glass in the form of chips and were used as received. Material transfers from the pretreatment stages to suspension in a solvent was effected in an inert atmosphere of dry nitrogen.

Thermal decompositions of the carbonyls were carried out in solution in round-bottom flasks with reflux condensor and heating mantle under dry nitrogen at approximately one atmosphere pressure. All decompositions were carried out in vented hoods and in some cases CO effluent was passed through solutions of phosphomolybdic acid in the presence of palladium chloride to afford molybdenum blue and carbon dioxide.

Magnetic measurements were made with a Princeton Applied Research Vibrating Sample Magnetometer, which measures magnetization M, at fields from 0 to 7,000 gauss. The instrument has a sensitivity of better than $1\times10^4$ emu/gauss and the accuracy and resettability of the applied field is within 1 gauss. The system was calibrated with a Ni standard (55.0 emu/gm) in a saturation field of 7 kilogauss. The magnetization, M, is read out digitally, directly in emu's. Mass magnetization, o, was obtained by dividing M by the sample mass in grams. The samples were contained in cylindrical Kel-F holders approximately ¼ inch in diameter and height. The amount of material used, 25 to 35 mg, was varied so that the volume of the sample would remain approximately the same. In the values reported, no attempt was made to account for the bulk shape demagnetization effects of the samples. The magnetization values obtained below the saturation region are the effective values for the above sample configuration. Packing density of the material was assumed to be the same in the hand tamped holder and in an uncompressed but tamped container.

EXAMPLE I

A mixture of about 50 ml of hollow glass spheres (FTF-15 Eccospheres) having an average particle diameter of between about 10 and 90 microns, about 60 ml of $Fe(CO)_5$, and about 40 ml of n-octane was refluxed for about 17 hours in a 250 ml flask. After cooling, the suspended solid was collected by filtration, washed with octane, acetone and ethyl ether and air dried to yield about 40 ml of coated spheres having a bulk density of less than about 0.45 g/cm$^3$. The remaining spheres were clumped to the bottom of the flask. Characterization of the magnetic parameters of the coated spheres provided the following values: saturation magnetization at 7,000 Gauss to about 100.3 emu/g., at 200 Gauss of about 49.9 emu/g.; remanence of about 4.3 emu/g.; a coercive force of about 14 Gauss; and an effective permeability of about 2.5. The coated spheres were heated in a ceramic container to red heat in the open air for several minutes and then cooled in the open air. Upon examination of the colored beads, they were found to have transparent optical properties and display magnetic properties. The color of the beads was found to vary from bead to bead ranging from a light amber to a dark opaque red. The magnetic response of the beads also varied with some beads being readily attracted to a magnet while others were not so attracted. Not unexpectedly, some of the final bodies were broken, fractured, or cracked.

EXAMPLE II

A mixture of about 10 grams of porous glass beads (XO-1, PPG) having an average particle diameter of between about 80 and 150 microns, about 10 ml of $Fe(CO)_5$, and about 50 ml of n-octane was refluxed for about 24 hours in a 300 ml flask. About 5 grams of materials was isolated as in Example I. The beads had a brillant luster. Characterization of the magnetic parameters of the coated spheres provided the following values: saturation magnetization at 7,000 Gauss of about 37.3 emu/g., at 200 Gauss of about 17.4 emu/g.; remanence of about 1.3 emu/g.; and a coercive force of about 14 Gauss.

Prior to heat-treatment, the material of Example I consists of elemental iron on a borosilicate glass substrate and that of Example II consists of elemental iron on a pure (99.5 percent) $SiO_2$ substrate. These materials have basically the same magnetic characteristics; that is, high saturation magnetization and initial susceptibility, small remanence and coercive force. Furthermore, the magnetic behavior displayed by these materials is consistent with that of magnetically soft iron. The differences in the saturation magnetization of these materials is due to differences in the iron coating thickness.

The effective permeability, $\mu_{eff}$, for the materials of these examples, may be obtained from the initial susceptibility data $\sigma$ and the measured bulk density (calculated within 5 percent) $\rho$ of the materials by the following relation:

$$\mu_{eff}=1+4\,(M/H)=1+4\pi(\sigma\rho/H)$$

where magnetization, M, is in emu/cm$^3$. Since these magnetic coated materials are spherical, the initial permeability of the individual bead is dependent upon shape demagnetization effects and in this case is limited to a value of 3. However, in the compacted "powder" form in which the beads are measured, particle-particle interactions and the shape demagnetization of the bulk sample can also introduce changes in the effective demagnetization effects.

From these observations, it may be concluded that the thermal decomposition of transition metal carbonyls such as iron pentacarbonyl onto silicaceous substrates produces mechanically and chemically stable composites which have the original substrate configuration, and which, additionally, display gross magnetism. The magnetic behavior observed for these magnetic composites is that typical of magnetically soft iron. The composites are, therefore, magnetic equivalents to their magnetic constituent yet afford a drastic reduction in density where such is desired. The composites show good initial magnetic response (indicated by a relatively high u) indicating the use of these materials as magnetic particles. Further, the various magnetic parameters, $M_s$, $H_c$, $\mu_{eff}$ of the magnetic materials can be controlled by varying the preparation and starting components of the materials. In addition, there is a direct relationship between the magnetic characteristics of the composites and their surface composition and morphology as reflected in the relative values of $X_i$, $M_s$ and $H_c$ for the materials of the examples.

Heat treatment and further examination of the iron coated porous glass beads prepared by the solution phase thermal decomposition of iron pentacarbonyl in the manner previously described in Example II was conducted. The colored magnetic material was prepared by heating decigram quantities of the metallized beads at red heat (<850° C.) for several minutes in a 20×150 mm test tube held over a Meeker burner flame and open to the air. Quenching of the beads was effected by pouring them into an open glass dish at room temperature. Microscopic examinations of the beads were done at 70× X on a binocular microscope with transmitted and reflected light.

Electron microscopy and diffraction analyses of crushed fragments of the amber magnetic material reveal crystallites of $\gamma$-$Fe_2O_3$ (maghemite), which range in size up to approximately 200 Å dispersed throughout the porous glass matrix. Morphologically, the porous glass itself appears unchanged and is composed of glass particles ($SiO_2$) ranging in size from approximately 50 Å up to at least 0.4 μm and fused in a three-dimensional network with interparticle separations of the order of 25–50 Å. The amount of $\gamma$-$Fe_2O_3$ present is estimated to be less than a few percent by weight.

A thin film of hematite, $\alpha$-$Fe_2O_3$, typically 0.1 to 0.5 μm may be found on the surface of the air heat-treated beads with crystallite grains ranging in size from approximately 0.1 to 0.4 μm. The $\alpha$-$Fe_2O_3$ phase may be detected by X-ray diffraction analysis of the micro beads, crushed or whole and by iron 2p and 3p photoelectronspectroscopy (ESCA) of the bead surfaces.

It is evident that the $\gamma$-$Fe_2O_3$, a well known ferrimagnetic ($\sigma s = 78$ emu/g), is responsible for the magnetism of the beads while $\alpha$-$Fe_2O_3$, a canted antiferrogmagnetic and normally red-brown to black in color contributes only to the optical absorption of the beads. Removal of the hematite, say by sputtering or preventative techniques, therefore, should render the bead even more transparent.

A magnetic characterization of the material confirmed the ferrimagnetic behavior of the material. However, a small remanence (~0.3 emu/g) and coercive force (20 Gauss) probably due to particule aggregation and shape were found, suggesting normal rather than superparamagnetic behavior despite the small crystallite size. Saturation moments of the materials ranged from about 4 to 10 electromagnetic units/gram. A comparison of the optical absorption and transmission characteristics of the beads with those of a standard sample of $\gamma$-$Fe_2O_3$ indicates that the amber or red color of the beads is due primarily to the presence of $\gamma$-$Fe_2O_3$ dispersed in the silicaceous matrix.

Figure 2:
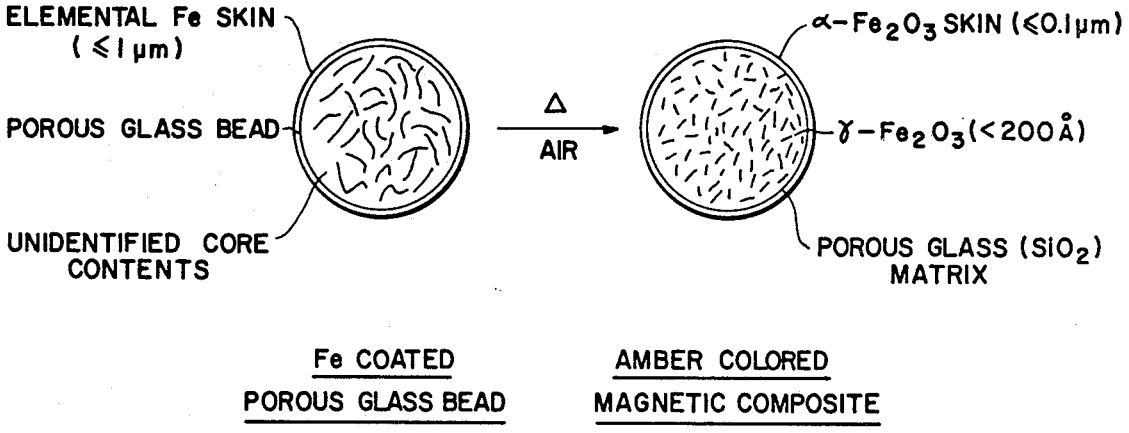

The overall formation of the colored magnetic material is schematically illustrated in FIG. 2. An attractive mechanism for the formation of $\gamma$-$Fe_2O_3$ in porous glass involves the back diffusion and subsequent oxidation and iron. The exact mechanism of formation of $\gamma$-$Fe_2O_3$ in the glass is unknown at this point, but obviously occurs as an oxidative process since all of the iron is initially in the zero-valent state. Both oxidizing and reducing agents (CO) may be present during reaction and $Fe_3O_4$ itself may be an intermediate.

Other modifications of the present invention will occur to those skilled in the art upon a reading of the present disclosure. There are intended to be included within the scope of this invention.

What is claimed is:

1. In a process for preparing a magnetically-responsive, composite particle, said process comprising placing in a suitable vessel particles of a silicaceous material having an average bulk density of between about 0.2 and about 3.0 gram/cm$^3$, a suspending medium, and a transition metal carbonyl selected from iron, cobalt, and nickel carbonyl, excluding air and moisture from said vessel by displacement with a dry inert gas, heating the mixture with agitation to reflux temperature for up to about 24 hours at the temperature of said suspending medium to thermally decompose said transition metal carbonyl whereupon said silicaceous material is coated with the magnetic elemental metal of said transition metal carbonyl, cooling the mixture, washing the metal coated silicaceous material with fresh suspending medium, drying the metal coated silicaceous material, the improvement comprising heating said metal coated silicaceous material in an ambient atmosphere for between about 2 minutes and about 120 minutes at a temperature of from between about 50° C. and about 700° C. to provide particles characterized as being colored, transparent in the wavelength region of from about 5,000 to about 8,000 Angstroms, and having a saturation moment of from about 4 to about 10 electromagnetic units per gram.

2. In a process for preparing a magnetically-responsive, composite particle in accordance with claim 1 wherein said silicaceous material is selected from the group consisting of hollow glass beads, foam glass nodules, solid glass beads, microporous glass beads, and glass chips.

3. In a process for preparing the magnetically-responsive, composite particle in accordance with claim 1 wherein said silicaceous material and said elemental metal are present in a volume ratio of from between about 5:1 to 20:1.

4. In a process for preparing a magnetically-responsive, composite particle in accordance with claim 1 wherein said metal carbonyl is selected from the group consisting of iron pentacarbonyl, di-iron nonacarbonyl, tri-iron dodecacarbonyl, and iron carbonyl cluster compounds.

5. In a process for preparing a magnetically-responsive, composite particle in accordance with claim 1 wherein said metal carbonyl is dicobalt octacarbonyl.

6. In a process for preparing a magnetically-responsive, composite particle in accordance with claim 1 wherein said metal carbonyl is nickel tetracarbonyl.

7. In a process for preparing a magnetically-responsive, composite particle, said process comprising placing in a suitable vessel particles of a porous silicaceous matrix having an average bulk density of from between about 0.2 and about 3.0 grams/cm$^3$, said silicaceous material being micro-reticulated and having pores with an average pore size of from between about 10 and about 500 Angstroms, adding a suspending medium, and a transition metal carbonyl selected from iron, cobalt, and nickel carbonyl, excluding air and moisture from said vessel by displacement with a dry inert gas, heating the mixture with agitation to reflux temperature for up to about 24 hours at the temperature of said suspending medium to thermally decompose said transition metal carbonyl whereupon said pores of said silicaceous matrix are impregnated with the magnetic elemental metal of said transition metal carbonyl, cooling the mixture, washing the metal impregnated silicaceous matrix with fresh suspending medium, drying the metal impregnated silicaceous matrix, the improvement comprising heating said metal impregnated silicaceous matrix in an ambient atmosphere for between about 2 minutes and about 120 minutes at a temperature of from between about 50° C. and about 700° C. to provide particles characterized as being colored, magnetic, and transparent in the wavelength region of from about 5,000 to about 8,000 Angstroms.

8. In a process for preparing a magnetically-responsive, composite particle in accordance with claim 7 wherein said silicaceous matrix has a surface area of up to about 400 m$^2$/gram.

9. In a process for preparing a magnetically-responsive, composite particle in accordance with claim 7 wherein said metal comprises a fine dispersion of ferrimagnetic $\gamma$-$Fe_2O_3$ throughout said silicaceous matrix.

10. In a process for preparing a magnetically-responsive, composite particle in accordance with claim 9 wherein said dispersion of ferrimagnetic $\gamma$-$Fe_2O_3$ comprises crystallites ranging in size of up to about 200 Angstroms.

11. In a process for preparing a magnetically-responsive, composite particle in accordance with claim 7 wherein said pores of said silicaceous material are impregnated with said metal in the form of continuous threads.

* * * * *